US008240070B1

(12) United States Patent
Phillips et al.

(10) Patent No.: US 8,240,070 B1
(45) Date of Patent: Aug. 14, 2012

(54) MATERIAL CONVEYOR SYSTEM CONTAINER

(75) Inventors: Paul D. Phillips, Frisco, TX (US); Jon D. Fisher, Frisco, TX (US); Victor A. Sahm, III, Dallas, TX (US)

(73) Assignee: Maxi-Lift, Inc., Addison, TX (US)

( * ) Notice: Subject to any disclaimer, the term of this patent is extended or adjusted under 35 U.S.C. 154(b) by 14 days.

(21) Appl. No.: 12/729,851

(22) Filed: Mar. 23, 2010

Related U.S. Application Data

(63) Continuation of application No. 11/646,899, filed on Dec. 28, 2006, now Pat. No. 7,698,839, which is a continuation of application No. 11/522,750, filed on Sep. 18, 2006, now abandoned.

(51) Int. Cl.
*E02F 3/40* (2006.01)

(52) U.S. Cl. ..... 37/444; 37/465; 37/906; 37/446; 198/713

(58) Field of Classification Search ..... 37/444, 37/443, 465, 398, 341, 906, 462, 463, 446, 37/305; 198/701, 711–714
See application file for complete search history.

(56) References Cited

U.S. PATENT DOCUMENTS

| | | | | | |
|---|---|---|---|---|---|
| 221,207 | A | * | 11/1879 | Avery | 198/713 |
| 1,559,004 | A | * | 10/1925 | Rattigan | 37/339 |
| 2,191,448 | A | * | 2/1940 | Bird | 37/195 |
| 2,584,025 | A | * | 1/1952 | Kelsey | 198/705 |
| 2,625,830 | A | * | 1/1953 | Transeau | 198/853 |
| 2,908,375 | A | * | 10/1959 | Smith et al. | 209/587 |
| 3,410,593 | A | * | 11/1968 | Goodman, Jr. | 294/68.23 |
| 3,529,677 | A | * | 9/1970 | Stephenson | 172/701.3 |
| 3,702,509 | A | * | 11/1972 | Zowaski | 37/97 |
| 3,934,654 | A | * | 1/1976 | Stephenson et al. | 172/701.3 |
| 4,246,999 | A | * | 1/1981 | Bryant et al. | 198/713 |
| 4,333,561 | A | * | 6/1982 | Schlegel | 198/703 |
| 4,407,081 | A | * | 10/1983 | Hanson | 37/454 |
| 4,770,288 | A | * | 9/1988 | Kruger | 198/711 |
| 4,958,721 | A | * | 9/1990 | Redford | 198/710 |
| 5,144,762 | A | * | 9/1992 | Robinson | 37/457 |
| 5,224,555 | A | * | 7/1993 | Bain et al. | 172/772.5 |
| 5,336,417 | A | * | 8/1994 | Hannum | 210/803 |
| 5,471,770 | A | * | 12/1995 | Ferreira | 37/264 |
| 5,611,157 | A | * | 3/1997 | Ferreira | 37/449 |
| 5,671,553 | A | * | 9/1997 | Burkhart | 37/270 |
| 5,911,667 | A | * | 6/1999 | Sanchis et al. | 53/531 |
| 6,018,894 | A | * | 2/2000 | Whitehead et al. | 37/285 |
| 6,041,529 | A | * | 3/2000 | Ruvang | 37/446 |
| H2020 | H | * | 5/2002 | Kesavan et al. | 37/455 |
| 6,695,127 | B1 | * | 2/2004 | Dobranski | 198/711 |
| D496,052 | S | * | 9/2004 | Braime et al. | D15/32 |
| 7,097,027 | B1 | * | 8/2006 | Chen | 198/713 |
| 7,765,726 | B2 | * | 8/2010 | Kuper | 37/460 |
| 2004/0206761 | A1 | * | 10/2004 | Frantz | 220/570 |
| 2007/0044349 | A1 | * | 3/2007 | McClanahan et al. | 37/452 |

OTHER PUBLICATIONS

Elevator Buckets Product Guide, cover and pp. 8, 10, 12, 20, 24, 30, 34, 36-38, 40-45 and 78, TAPCO, Inc., St. Louis, MO (Date Unknown).

* cited by examiner

*Primary Examiner* — Matthew Buck
(74) *Attorney, Agent, or Firm* — Gardere Wynne Sewell, LLP

(57) ABSTRACT

Molded polymer elevator buckets are reinforced by tapering the thickness of front and sidewalls and integral arcuate corner parts to improve bucket life without significant weight increase or reduced bucket capacity. Front lip wear indicators may be molded into the front wall section delimited by the lip and/or on the arcuate corner parts.

19 Claims, 3 Drawing Sheets

| NOMINAL BUCKET DIMENSION | SIDE THICKNESS | FRONT CORNER | FRONT LIP | % DIFF SIDE TO FRONT CORNER | % DIFF SIDE TO FRONT LIP |
|---|---|---|---|---|---|
| 6X4 | 0.226 | 0.297 | 0.265 | 24% | 15% |
| 9X5 | 0.260 | 0.345 | 0.315 | 25% | 17% |
| 9X6 | 0.270 | 0.345 | 0.340 | 22% | 21% |
| 10X6 | 0.270 | 0.345 | 0.340 | 22% | 21% |
| 11X6 | 0.270 | 0.345 | 0.340 | 22% | 21% |
| 12X6 | 0.270 | 0.345 | 0.340 | 22% | 21% |
| 11X7 | 0.300 | 0.400 | 0.386 | 25% | 22% |
| 12X7 | 0.300 | 0.400 | 0.386 | 25% | 22% |
| 14X7 | 0.300 | 0.400 | 0.386 | 25% | 22% |
| 16X7 | 0.300 | 0.400 | 0.386 | 25% | 22% |
| 14X8 | 0.340 | 0.450 | 0.415 | 24% | 18% |
| 16X8 | 0.362 | 0.455 | 0.440 | 20% | 18% |
| 18X8 | 0.362 | 0.455 | 0.440 | 20% | 18% |

*FIG. 5*

MATERIAL CONVEYOR SYSTEM CONTAINER

CROSS REFERENCE TO RELATED APPLICATION

This application is a continuation of co-pending application Ser. No. 11/646,899, filed Dec. 28, 2006, which is a continuation of Ser. No. 11/522,750 filed Sep. 18, 2006.

BACKGROUND OF THE INVENTION

In the art of elevator-type material conveyor systems, containers or so-called "buckets" are supported spaced-apart on an endless belt or chain-like conveyor for moving particulate material substantially vertically at least between a first elevation and a second and higher elevation. A common application for elevator-type conveyor systems and the buckets associated therewith is for grain elevators as well as other applications wherein granular or particulate solid materials or material mixtures are conveyed by immersing the buckets in the material as the buckets move along the path of the endless belt or chain support structure. Heretofore, suitable materials for use in elevator buckets comprise polymers such as polyethylene, polyurethane and nylon. Material selection is based on cost, environmental factors and the particular type of material being conveyed.

A longstanding problem with elevator buckets relates to excessive wear on the buckets incurred as they enter the flow of material being conveyed to scoop up or fill the buckets while they pass along their path of movement. Premature failure and loss of bucket capacity can, of course, adversely effect material transport operations. Increasing material thickness uniformly throughout the bucket structure is disadvantageous from the standpoint of cost and the added tare weight of the buckets, for example. Accordingly, there has been a need to develop an elevator bucket which has an improved working life, is not subject to premature wear to the extent that the bucket will fail and will not likely undergo measurable, reduced capacity. It is to these ends that the present invention has been developed.

SUMMARY OF TEE INVENTION

The present invention provides an improved material handling bucket, particularly an elevator bucket used in elevator type conveyor systems.

In accordance with one important aspect of the invention, an elevator bucket is provided which has a thickened front wall and lip portion generally disposed at the point of insertion of the bucket into the material being conveyed by the bucket. In accordance with another aspect of the invention, an elevator bucket is provided which has sidewalls and, particularly, arcuate corner parts joining the sidewalls to a front wall or lip and which are provided of thickened material of which the bucket is made. The increased wall and corner part thickness is graduated from the leading edge of the front wall or lip of the bucket through the remainder of the front or bottom wall, the sidewalls and through the extent of the arcuate integral corner parts joining the sidewalls to the front or bottom wall.

Still further, the invention contemplates the provision of an elevator bucket having suitable indicia disposed on and adjacent to the front lip, or front wall portion of the bucket for measuring erosion or wear of the bucket lip and front wall so that a visual inspection can be made periodically to determine if the capacity of the bucket is being reduced and/or if failure of the bucket may be imminent as a result of excessive wear.

Those skilled in the art will further appreciate the above-mentioned advantages and superior features of the invention together with other important aspects thereof up reading the detailed description which follows in conjunction with the drawings.

BRIEF DESCRIPTION OF THE DRAWINGS

FIG. 5 is a table of selected preferred dimensions for a series of different sizes of elevator buckets in accordance with the invention.

DETAILED DESCRIPTION OF THE PREFERRED EMBODIMENTS

Figure 1:
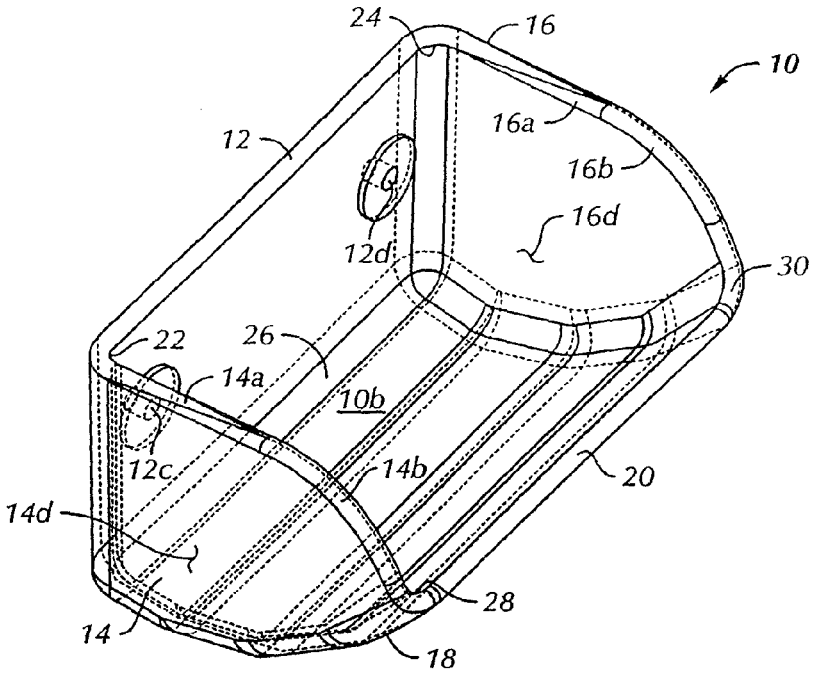
FIG. 1 is a perspective view of an improved elevator bucket in accordance with the present invention.

In the description which follows, like parts are marked throughout the specification and drawings with the same reference numerals, respectively. The drawing figures may not necessarily be to scale and certain features may be shown in somewhat schematic form in the interest of clarity and conciseness.

Figure 2:
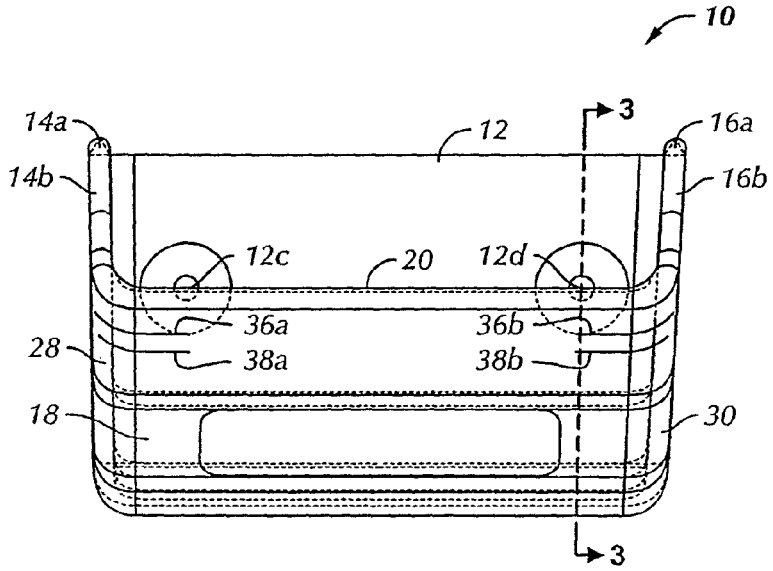
FIG. 2 is a front elevation view of the elevator bucket shown in FIG. 1.
Figure 3:
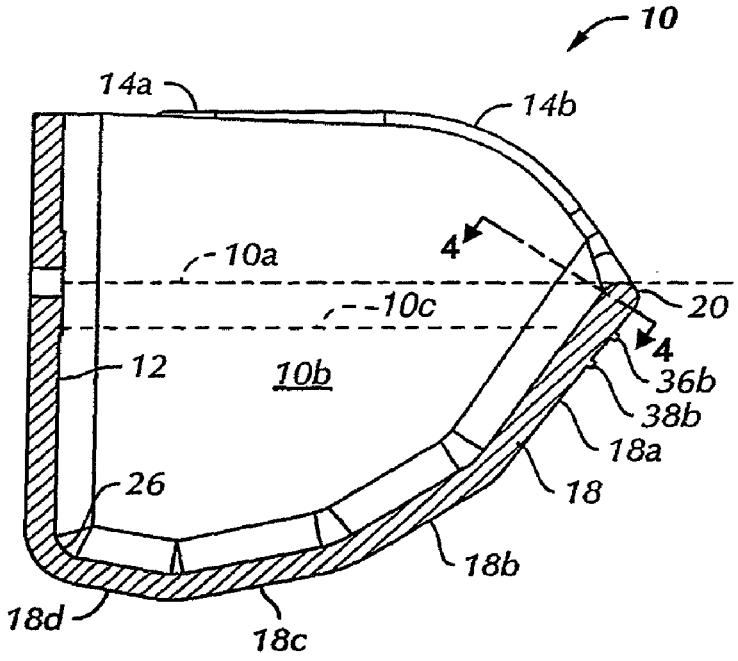
FIG. 3 is a section view taken along the line 3-3 of FIG. 2.

Referring to FIG. 1, there is illustrated an elevator bucket in accordance with the invention and generally designated by the numeral 10. The bucket 10 is characterized by a backwall 12, opposed sidewalls 14 and 16 and a combined front and bottom wall 18 delimited by a lip 20. Backwall 12 and sidewalls 14 and 16 are joined by integral arcuate corner parts 22 and 24, backwall 12 is joined to combined bottom and front wall 18 by an arcuate corner part 26 and combined bottom and front wall 18 is joined to sidewalls 14 and 16 by integral arcuate corner parts 28 and 30. The solid and dashed lines at the corner parts and arcuate edges denote points of tangency of the arcuate corner parts, edges and lip with adjacent planar surfaces. As shown in FIG. 3, combined bottom and front wall 18 is preferably formed of integral generally planar wall segments including a segment or section 18*a* which is delimited by lip 20 and segments 18*b*, 18*c* and 18*d*, the last mentioned of which is joined to backwall 12 by arcuate corner part 26. Sidewalls 14 and 16 are delimited by top edges 14*a* and 16*a* which merge with depending arcuate wall edges 14*b* and 16*b*, respectively, which join the integral corner parts 28 and 30, respectively. As shown in FIGS. 2 and 3, sidewalls 14 and 16 are substantially normal to the backwall 12 and are delimited by the edges 14*a*, 14*b*, and fully arcuate edges 16*a* and 16*b* which join the lip 20 at arcuate corner parts 28 and 30. Backwall 12 is provided with plural spaced apart fastener receiving openings 12*c* and 12*d* which may have integral washerface bosses formed therearound, as illustrated.

Figure 4:
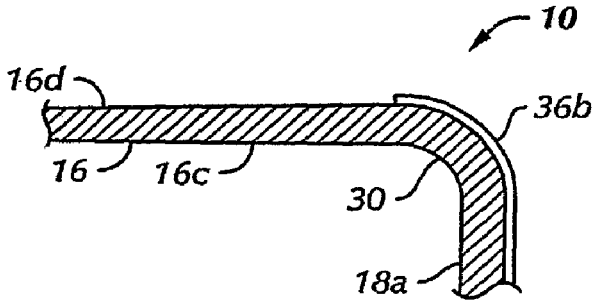
FIG. 4 is a detail section view taken along the line 4-4 of FIG. 3.

Referring to FIGS. 2, 3 and 4, one advantage of the elevator bucket 10 is the provision of wear indicators or indicia indicating the extent of wearing away of the lip 20 including that portion at its juncture with the sidewall upper edges 14*b* and 16*b*. As shown in FIGS. 2 and 3, spaced apart wear indicators 36*a* and 36*b* and 38*a* and 38*b*, FIG. 2, are provided on the wall segment or section 18*a* spaced from the lip 20, as shown. Wear indicators 36*a*, 36*b*, 38*a* and 38*b* are provided as ridges molded into the bucket 10, but may be molded as grooves also, for example. In this way, in use of the elevator bucket 10, a person may view the bucket as it progresses along its conveyor path to indicate whether the front lip 20 has worn away sufficiently to require replacement of the bucket. This is important because as lip 20 wears away the capacity of the bucket 10, essentially determined by the line 10*a* in FIG. 3, will become less as the combined front and bottom wall segment 18*a* wears away toward its juncture with wall segment 18*b*, thus reducing as indicated by line 10*c* the volume of the space 10*b*, FIG. 3, which is the working volume of the bucket 10.

In order to improve the life of the bucket 10 without significantly increasing the weight thereof, or reducing the working volume thereof or increasing the cost thereof, as compared with prior art buckets, the combined bottom wall and front wall 18, particularly with respect to the section or segment 18*a*, has an increased thickness as compared with wall segments or sections 18*b*, 18*c* and 18*d*. Beginning at the arcuate convex lip 20, which delimits the upper end of the wall segment or section 18*a*, the thickness of the wall section 18*a* is at its greatest and such thickness gradually is reduced or tapers toward the section or segment 18*b*, as shown. In like manner, the arcuate corner parts 28 and 30 each have an increased thickness at junctures with lip 20, respectively, and which is commensurate with the graduated thickness of the wall segment 18*a* and this thickness is blended into wall segment 16*c*, for example, see FIG. 4, which has an increased thickness between the arcuate corner part 30 and the remainder of sidewall 16 which is a major portion of sidewall 16, designated by numeral 16*d*, and is of substantially constant thickness. Sidewall 14 is similarly configured and has a major portion 14*d*, FIG. 1, which is also of substantially constant thickness. Thus, without significantly increasing the weight of the bucket 10 or reducing its working volume, the bucket is reinforced at the lip 20, the arcuate corner parts 28 and 30, and portions of the sidewalls 14 and 16 which join the combined bottom wall and front wall 18 at the corner parts 28 and 30.

It has been discovered that, by increasing the wall thickness for buckets made out of the materials indicated above, namely polyethylene, polyurethane or nylon, and wherein the thickness of the sidewalls 14 and 16 is a predetermined amount, and the thicknesses of the arcuate corner parts 28 and 30 are a greater predetermined amount at the juncture of these corner parts with the wall section 18*a* and a lip 20, an improved life of elevator buckets of the type described herein has been realized without sacrificing cost, significantly increased weight or reduced working volume of a bucket. As shown in FIG. 5, for respective buckets having nominal dimensions, as indicated, in inches of the major portions 14*d* and 16*d*, the thickness of sidewalls 14 and 16 is indicated in inches and the thickness of corner parts 28 and 30 at lip 20 is indicated in inches together with the maximum thickness of the wall section 18*a* at arcuate lip 20. The values and ranges indicated are percent difference in maximum wall thickness of the corner parts 28 and 30 as compared with the sidewalls and the percent difference in the thickness of lip 20 and maximum thickness of the wall section 18*a* as compared with the sidewalls. The percent differences are calculated by dividing the differences between sidewall thickness and front corner part or lip thickness by the front corner part or lip thickness, respectively. With the values given in FIG. 5, advantages of longer bucket life and reduced wear of lip 20 and wall segment 18*a* have been realized. The nominal dimensions of the buckets indicated in FIG. 5 comprise the width of the space 10*b* between the walls 14 and 16 and the overall depth of the bucket as measured from the top edges 14*a* or 16*a* to the lowermost point within the space 10*b*, which is nominally the juncture of the wall sections 18*c* and 18*d*.

Accordingly, by providing a series of elevator buckets having nominal dimensions as indicated in FIG. 5 and wherein the relationship of the sidewall thickness to the corner parts and front lip thickness, respectively indicated, elevator buckets meeting the desired criteria described herein have been realized.

Fabrication of the elevator bucket 10 and related, nominally dimensioned buckets, as described and as tabulated in FIG. 5, may be carried out using conventional polymer molding methods to provide a rugged, integral one-piece bucket with increased service life heretofore unappreciated in the art. Although preferred embodiments of the invention have been described in detail herein, those skilled in the art will recognize that various substitutions and modifications may be made without departing from the scope and spirit of the appended claims.

The invention claimed is:

1. An elevator bucket, comprising:

a back wall, a bottom wall, opposed sidewalls and a front wall joined to the opposed sidewalls forming an open top, the front wall joined to the opposed sidewalls by arcuate corner parts, the front wall having a lip extending between the opposed sidewalls;

wherein the thickness of the front wall and the arcuate corner parts is increased and gradually tapers to a lesser thickness from the lip to the back wall to maintain a constant working volume of the elevator bucket; and wherein a single material defines the thickness of the front wall and the arcuate corner parts.

2. The elevator bucket of claim 1, further including wear indicia extending along at least a part of one of said arcuate corner parts and at least a part of said front wall.

3. The elevator bucket of claim 2, wherein said wear indicia comprises at least one ridge.

4. The elevator bucket of claim 2, wherein said wear indicia comprises a groove.

5. The elevator bucket of claim 1, further comprising fastener receiving openings formed on the back wall.

6. The elevator bucket of claim 1, wherein said opposed sidewalls comprise top edges merging with depending arcuate wail edges.

7. The elevator bucket of claim 1, wherein the elevator bucket is formed of, and the single material is, a polymer material.

8. An elevator bucket, comprising:

a back wall, a pair of opposed sidewalls and a planar bottom wall forming an upper opening;

wherein the planar bottom wall has an increased thickness portion and a tapered thickness portion blending into a reduced thickness from a front lip to the back wall to increase the life of the bucket;

wherein the increased thickness portion, the tapered thickness portion, and the planar bottom wall each are formed of the same uniform material; and wherein the bottom wall is joined to the opposed sidewalls by arcuate corner parts, the arcuate corner parts having an increased thickness portion and a tapered thickness portion blending into the reduced thickness.

9. The elevator bucket of claim 8, further including wear indicia extending along at least a part of the bottom wall.

10. The elevator bucket of claim 8, wherein the wear indicia extend along at least portion of at least one of the opposed sidewalls.

11. The elevator bucket of claim 8, wherein the elevator bucket is formed of and the same uniform material is, a polymer material.

12. The elevator bucket of claim 9, wherein the wear indicia comprise a ridge extending at least partially on the bottom wall.

13. The elevator bucket of claim 9, wherein the wear indicia comprise a groove extending at least partially on the bottom wall.

14. A method of manufacturing an elevator bucket, comprising:

forming a back wall;

forming opposed sidewalls; and forming from a uniform material a planar front wall and an arcuate corner part at a juncture of the planar front wall with one of the opposed sidewalls, the planar front wall and the arcuate corner part each having an increased thickness portion and a tapered thickness portion, blending into a reduced thickness the increased thickness portion of the planar front wall defining a lip.

15. The method of claim 14, further comprising forming wear indicia along at least a portion of the front wall.

16. The method of claim 15, wherein forming the wear indicia comprises forming a groove along at least a portion of the front wall.

17. The elevator bucket of claim 14, wherein the elevator bucket is formed of, and the uniform material is, a polymer material.

18. The elevator bucket of claim 14, further comprising fastener receiving openings formed on the back wall.

19. An elevator bucket, comprising:

a single uniform body formed of a single uniform material having portions comprising:

a back wall, a pair of opposed sidewalks, and a bottom wall, the bottom wall having a lip portion opposite the back wall;

a junction of each sidewall with the lip portion of the bottom wall defining respective arcuate edge portions;

wherein the lip portion has an increased thickness tapering toward a lesser nominal wall thickness of the bottom wall; and wherein the arcuate edge portions have the increased thickness portion tapering toward the lesser nominal wall thickness of respective sidewalk.

* * * * *

UNITED STATES PATENT AND TRADEMARK OFFICE

CERTIFICATE OF CORRECTION

PATENT NO. : 8,240,070 B1
APPLICATION NO. : 12/729851
DATED : August 14, 2012
INVENTOR(S) : Paul D. Phillips et al.

It is certified that error appears in the above-identified patent and that said Letters Patent is hereby corrected as shown below:

In the Specification:

At column 1, line number 44, please replace the subtitle [SUMMARY OF TEE INVENTION] with the following subtitle -- SUMMARY OF THE INVENTION --.

In the Claims:

At column 4, claim number 6, line number 42, please replace the word [wail] with the word -- wall --.

At column 4, claim number 8, line number 47, please insert the word -- generally -- before the word “planar”.

At column 6, claim number 19, line number 9, please replace the word [sidewalks] with the word -- sidewalls --.

At column 6, claim number 19, line number 20, please replace the word [sidewalk] with the word -- sidewall --.

Signed and Sealed this
Second Day of October, 2012

David J. Kappos

David J. Kappos
*Director of the United States Patent and Trademark Office*